US006631836B2

(12) United States Patent
Dickhaut

(10) Patent No.: US 6,631,836 B2
(45) Date of Patent: Oct. 14, 2003

(54) ACCESSORY DEVICE FOR NAIL AND STAPLE GUNS

(76) Inventor: John Dickhaut, 1315 McCormack Road, Saskatoon, SK (CA), S7M 4Y6

( * ) Notice: Subject to any disclaimer, the term of this patent is extended or adjusted under 35 U.S.C. 154(b) by 35 days.

(21) Appl. No.: 09/799,306

(22) Filed: Mar. 5, 2001

(65) Prior Publication Data

US 2001/0038026 A1 Nov. 8, 2001

Related U.S. Application Data

(60) Provisional application No. 60/186,794, filed on Mar. 3, 2000.

(51) Int. Cl.[7] ..... B25C 7/00

(52) U.S. Cl. ..... 227/148; 227/128; 227/151; 227/152

(58) Field of Search ..... 227/110, 111, 227/120, 124, 128, 148, 151, 152, 156, 146

(56) References Cited

U.S. PATENT DOCUMENTS

| | | | | |
|---|---|---|---|---|
| 2,768,376 A | * | 10/1956 | Critchley | 365/130 |
| 2,774,969 A | * | 12/1956 | Samples | 227/147 |
| 2,822,544 A | * | 2/1958 | Anstett | 227/147 |
| 2,866,199 A | * | 12/1958 | Freeman et al. | 173/121 |
| 3,012,247 A | * | 12/1961 | Sillars et al. | 227/121 |
| 3,112,488 A | * | 12/1963 | Dettloff et al. | 227/127 |
| 3,281,046 A | * | 10/1966 | Boulay | 227/109 |
| 3,360,176 A | * | 12/1967 | Geh et al. | 227/148 |
| 3,542,273 A | * | 11/1970 | Hedrick | 227/130 |
| 4,732,307 A | | 3/1988 | Hubbard et al. | |
| 4,763,825 A | * | 8/1988 | Albin | 227/142 |
| 5,261,588 A | | 11/1993 | Lin | |
| 5,628,445 A | | 5/1997 | Braddock et al. | |
| 5,649,660 A | | 7/1997 | Akiba et al. | |

FOREIGN PATENT DOCUMENTS

| | | |
|---|---|---|
| CA | 2009252 | 9/1993 |

* cited by examiner

*Primary Examiner*—Scott A. Smith
*Assistant Examiner*—Nathaniel Chukwurah
(74) *Attorney, Agent, or Firm*—Sheldon H Parker

(57) ABSTRACT

An accessory device for fastener-driving tools such as nail and staple guns is provided. The device serves as a positioning guide for the tool and is designed to provide sufficient spacing and orientation between the fastener-driving tool and the target construction material. The device can be integrated into the body of the fastener-driving tool, manufactured as an attachment or manufactured as a separate tool. It prevents impact marring at the visible surface of the construction material by redirecting the force of the blow to a non-visible surface on the assembled construction material. Furthermore it increases speed and ease of movement for the user by serving as a guide for stability and ease of alignment. The device changes the impact point between the driving tool and the construction material, broadens the area of impact and protects the top edge of a tongue and groove construction material from impact damage.

8 Claims, 8 Drawing Sheets

ACCESSORY DEVICE FOR NAIL AND STAPLE GUNS

CROSS-REFERENCE TO RELATED APPLICATION

This application is a continuation-in-part of provisional application Ser. No. 60/186,794 filed on Mar. 3, 2000, the disclosure of which is incorporated herein by reference, as though recited in full.

BACKGROUND OF THE INVENTION

1. Field of the Invention

The present invention relates to a shoe for fastener driving tools such as nail and staple guns, used in construction and home improvement. In particular, the shoe can be a part of the gun, an attachment or a separate device that serves as a positioning guide and is designed to provide sufficient spacing and orientation between the fastener driving tool and the target construction material to prevent impact marring of the material surface and to increase speed and ease of movement for the user. The shoe changes the impact point between the driving tool and the construction material and, in particular, protects the top edge of a tongue and groove construction material.

2. Description of the Prior Art

Fastener driving tools such as pneumatic and manually driven nail and staple guns are commonly used in construction to provide improved speed and efficiency for construction workers. These tools are used in many construction and home improvement projects on various building elements such as floors, walls and roofs. Modern construction techniques emphasize speed and volume to drive the economics and much of the attention of the focus of improvements to tools is on speed, spacing and aim involved.

For example, Hubbard et al in U.S. Pat. No. 4,732,307 describe a device to place two nail guns in combination to effectively nail edges of adjacent panel members and to control spacing. Similarly, Lin in U.S. Pat. No. 5,261,588 and Braddock in U.S. Pat. No. 5,628,445 both describe auxiliary sliding elements fastened to the nail cartridge or magazine of a nail gun to provide better spacing and precise angles for wall boards ('307) and shingles ('445).

Other improvements to nail guns are aimed at providing guidance for the worker. These guides may be attached to the tool or may be separate. Yoshitaka and Kunio in U.S. Pat. No. 5,649,660 have provided a nail gun with a bit guide to improve direction and aim when attaching baseboards. Further, Jensen in CA2,009,252 provides for a system for positioning fasteners while using a nail gun. This invention describes a connector, separate from the tool, for positioning fasteners to a wall prior to fastening with the tool.

Waste, on the other hand, has been addressed nominally on project budgets and even less in improvements to tools. Waste during construction is a considerable problem and design of tools to reduce waste is lacking. Common causes of waste and rework include damage caused to construction materials by the tools themselves. For example, in assembling wood floors, considerable effort is required to prevent impact damage to the floorboard caused by the pneumatic or manual fastener-driving tool. The tool abuts the floorboard at one or more points and when the fastener is driven into the tongue of the board to set it, the tool can impact the board causing marring or damage to the surface appearance of the board. This is a common problem for unskilled homeowners making improvements to their home and to apprentice carpenters new to the floor assembly process. When impact damage occurs to a floorboard or other construction material, refinishing is not always possible to correct the damage and the damaged material must be removed entirely and replaced. This causes considerable increases in costs due to waste and lost time.

SUMMARY OF THE INVENTION

It is an object of the invention to provide a device to eliminate impact damage to construction materials caused by fastener-driving tools and to facilitate the use and accuracy of the tool.

It is a further object of the invention to reduce waste and cost caused by impact damage on construction materials and necessary reconstruction.

It is a further object of the invention to improve efficiency of use of fastener-driving tools.

It has now been found that objects of the invention can be achieved by changing the contact point between the fastener-driving tool and the construction material. An additional feature of the invention improves the speed of use of fastener-driving tools by providing a consistent contact point between the fastener-driving tool and the construction material. Providing a floating contact point that can guide the fastener-driving tool along the construction material when multiple fasteners are required increases speed and efficiency further. The design of the attachment reduces the likelihood that the fastener-driving tool will rock, providing consistent fastening and a reduced chance of error that requires rework. In the example of flooring construction, the contact point is moved from a point above the tongue to the tongue of a tongue and groove plywood or hardwood. Furthermore, the impact on the tongue is dispersed over a wider area, preventing any damage to the tongue and allowing the adjoining piece to fit properly.

The foregoing and other objects are achieved by providing fastener-driving tools with a cradle or shoe of molded plastic, rubber, Teflon or formed wood which can be adapted to each tool and which eliminates any contact point between the tool and the top edge of the construction material other than the point of entry of the fastener. This provides a non-marring contact surface and guide at an appropriate point between the tool and the construction material and improves speed and efficiency while reducing waste. The cradle or shoe can be a separate device, can be an add-on attachment, or can be an integral element of the tool.

In one embodiment, the invention has been designed to attach to either a Stanley-Bostitch Mark III flooring stapler or a Powernailer® Model 200 nailer. The invention quickly and easily installs onto the flooring stapler and is attached in place of a Teflon plate that is located on the bottom of the flooring stapler. This Teflon plate allows the nailer to contact the construction material just below the top edge of the finished product. The thickness of the Teflon plate dictates precisely where the nailer will contact the construction material. Typically the plate makes contact above the tongue on a tongue and groove floorboard. Damage can occur to the construction material if the nailer is not seated properly. The next floorboard may still fit but visible damage can be seen on the finished surface. This is unacceptable in construction and requires rework to remove and replace the damaged board.

Replacing the Teflon plate with the invention eliminates this point of impact between the flooring stapler and the floorboard, disperses the impact over a wider area and eliminates impact damage. The impact point is moved to the tongue and when an adjoining board is fitted into place, the contact point is covered. If any damage is done to the contact point, it will not be visible in the finished product.

The invention also provides a guide so the flooring stapler can be placed consistently on the floorboard and which necessarily limits the point of impact to the point where the nail or staple enters the floorboard. The invention is lightweight and can be made of high impact molded plastic, rubber or other suitable materials. It is designed to be used by home construction enthusiasts all the way to master carpenters. It is sufficiently flexible for use with staples, nails or with power cleats. It can also be used as separate device to move tongue and groove floorboards into place, as in the example of glued flooring. Thus in non-stapled, glue-affixed flooring, the device can be used to place the floorboards together without the step of driving a nail or staple afterward.

Flooring staplers and nail guns are commonly used in construction and it will be obvious to those skilled in the art that the present invention can be applied to any brand or make of such tool.

BRIEF DESCRIPTION OF THE DRAWINGS

The advantages of the disclosure will become more apparent when read with the specification and the drawings, wherein.

DETAILED DESCRIPTION OF THE PREFERRED EMBODIMENTS OF THE INVENTION

The foregoing problems are overcome by the invention by providing a nail gun with the first embodiment of the present invention and will be described with reference to FIGS. 3 through 12.

Figure 1:
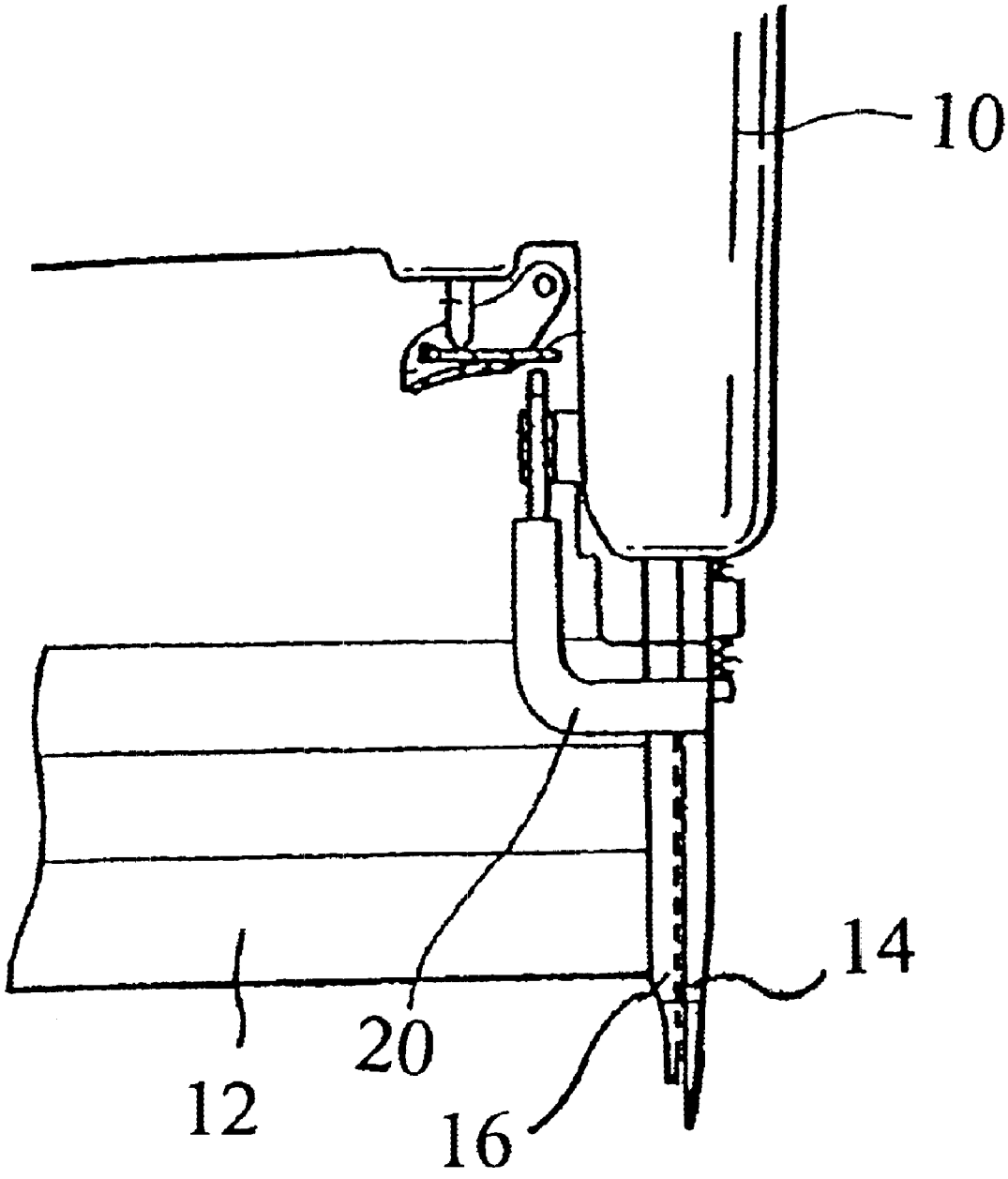
Figure 1 PRIOR ART
FIG. 1 is side view showing a conventional nail gun.

The basic nail gun is shown in FIG. 1 and includes a main body 10, a magazine 12, a bit guide 14, and a contact arm 20 having a tapered end portion to contact with the construction material. The magazine 12 is provided for accommodating therein congregated nails 16 in which nails are arrayed side by side and bonded together.

Figure 2:
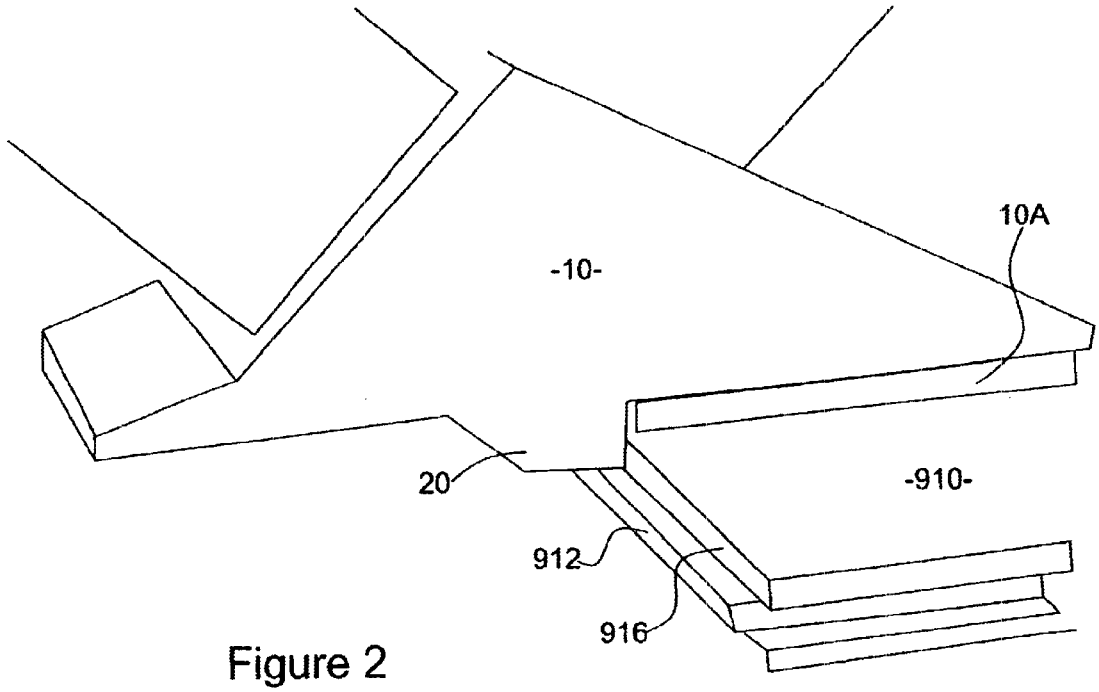
Figure 2 Prior Art
FIG. 2 is an angled view showing the interaction between a conventional nail gun and the flooring material.

FIG. 2 shows the positioning of the basic nail gun when it comes in contact with flooring 910. The main body 10, Teflon plate 10A and contact arm 20 are shown as they interact with the flooring 910. The Teflon plate 10A rests on the surface of the flooring material 910 and the depth of the Teflon plate 10A determines where the contact arm 20 impacts the flooring material 910. Impact damage close to the top surface of the flooring material 910 is caused by not having the nailer aligned properly before driving the fastener and thusly undesired contact between the nail gun and the visible surface of the flooring 910. This damage remains visible even after the next row is adjoined and requires rework or replacement to correct the flaw.

Figure 3:
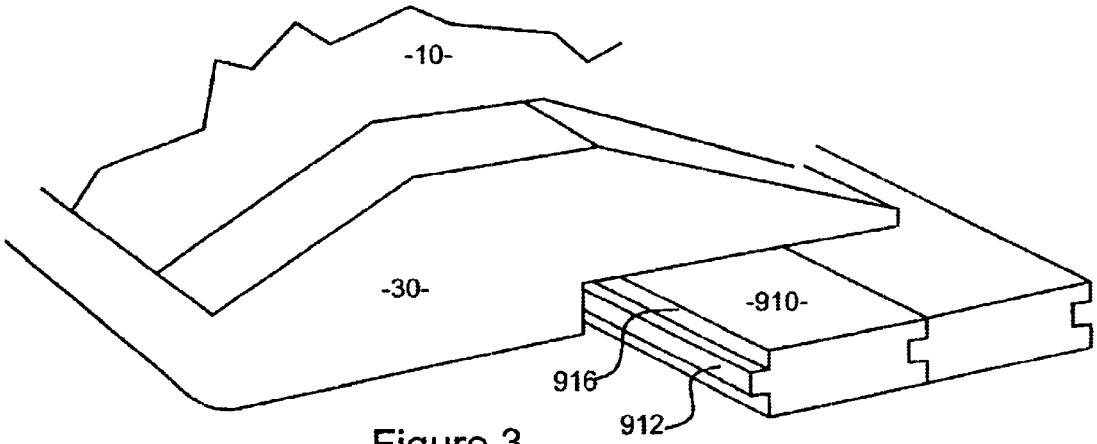
FIG. 3 is an angled view showing the interaction between a nail gun and the flooring material when the described invention is attached to a nail gun.

FIG. 3 shows the positioning of the nail gun and attachment 30 as it comes in contact with flooring 910. The main body 10 of the nail gun is cradled in the attachment 30. The attachment 30 impacts front of the tongue 912 only and the top surface of the flooring 916 is not impacted at all when the staple or nail is driven into the flooring 910.

Figure 4:
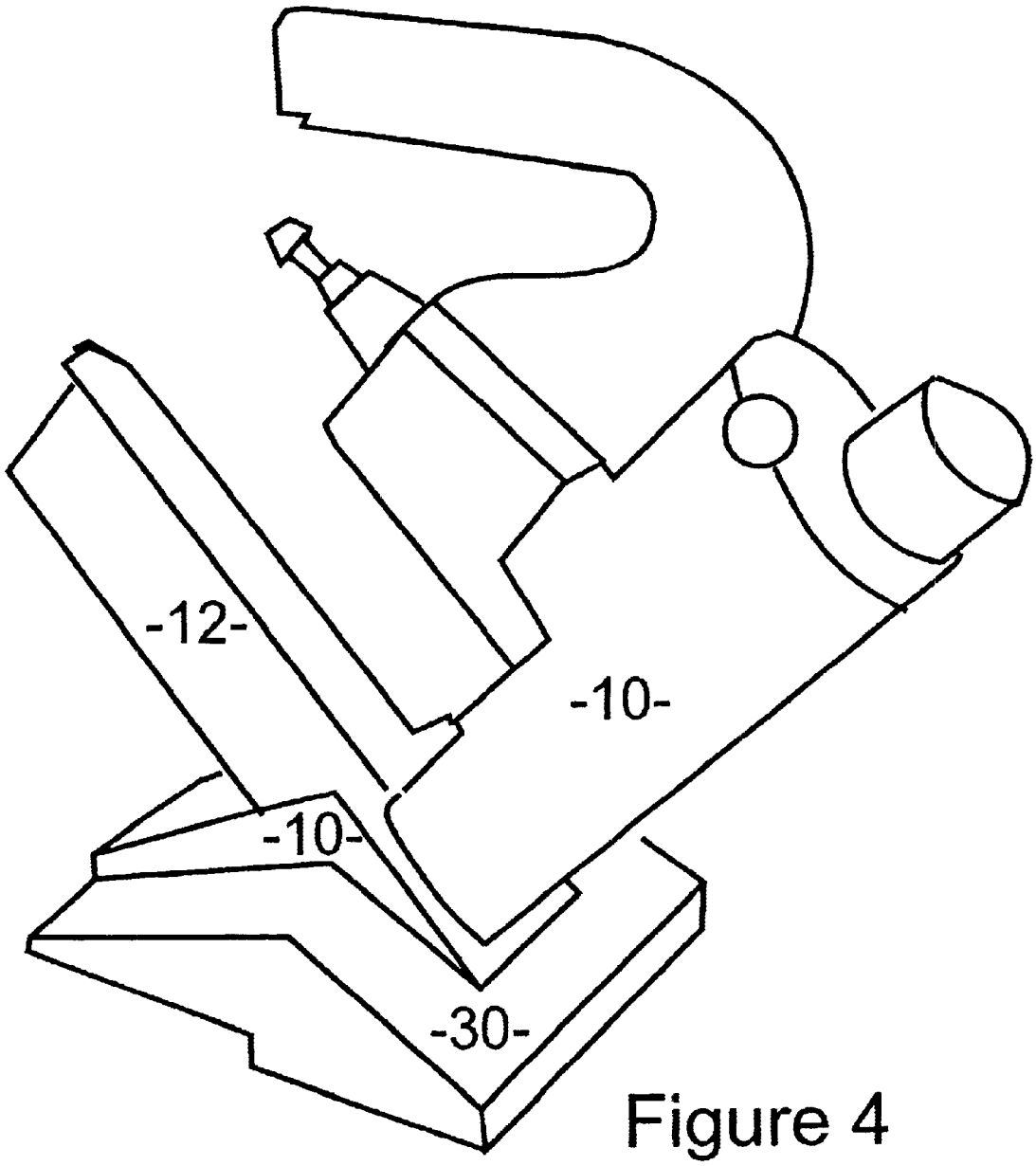
FIG. 4 is an angled view of the described invention as attached to a nail gun.

FIG. 4 shows the assembly of the Mark III flooring staple and the described invention. The invention serves as a cradle or shoe for the contact arm of the nail gun or flooring stapler and the contact arm is hidden by the position of the invention. The main body 10 of the nail gun is cradled in the attachment 30. The magazine 12 of the nail gun extends from the attachment 30 and allows nails or staples to be fed to the contact arm of the nail gun.

Figure 5:
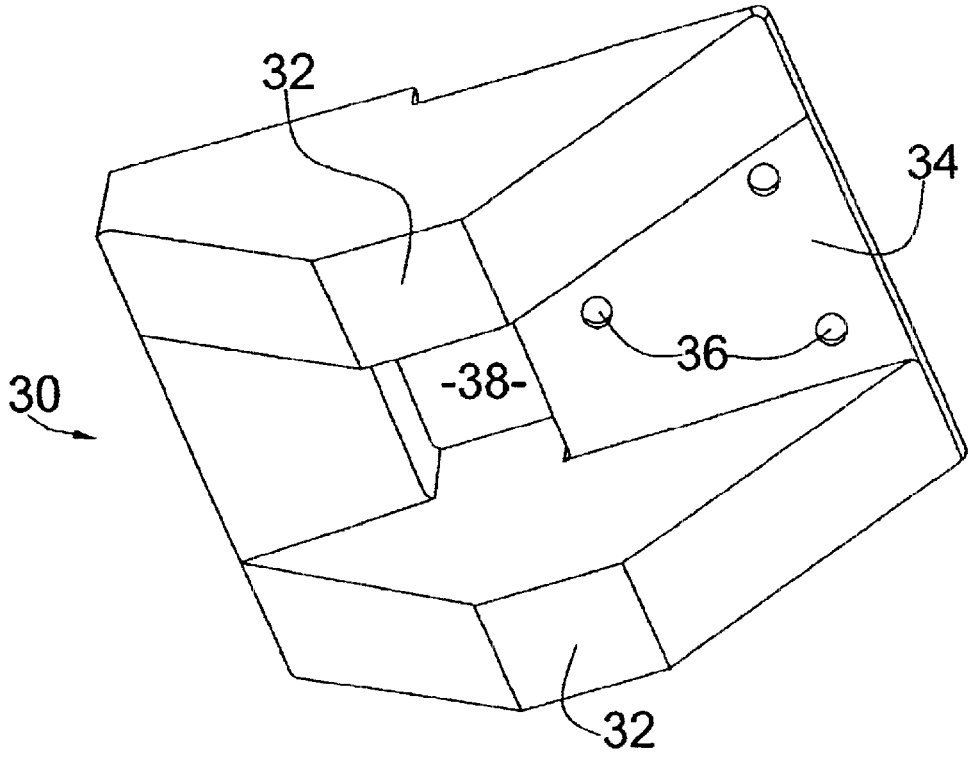
FIG. 5 is an angled top view of the described invention.

FIG. 5 shows an oblique top angle of the attachment 30. Two arms 32 extend vertically upward from the body of the attachment to provide a guide for placement of the tool into the cradle and to stabilize the tool to eliminate inadvertent movement during use. An attachment surface 34 for connecting the attachment 30 to the tool is provided with holes 36 for screws to attach the device to the contact arm of the fastener-driving tool. Finally an opening 38 is provided in the attachment 30 to provide a place for the nails or staples to pass through when being applied to the construction material.

Figure 6:
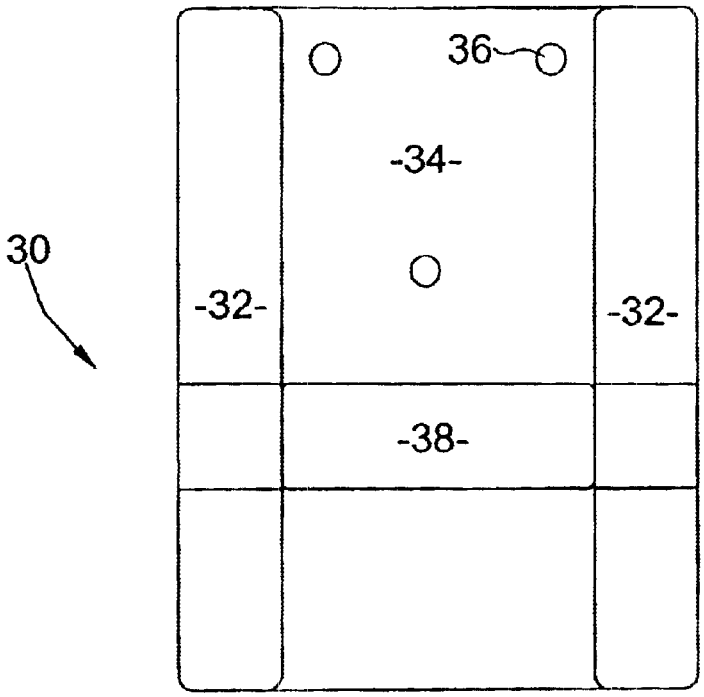
FIG. 6 is a direct top view of the invention.

FIG. 6 shows a direct top view of the attachment 30 showing the position of the vertical arms 32, the attachment surface 34, the attachment holes 36 and the opening 38 to allow nails or staples to pass through.

Figure 7:
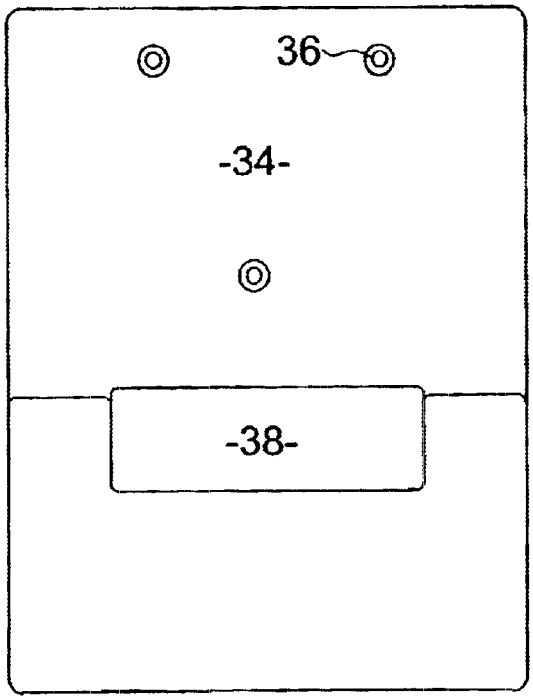
FIG. 7 is a direct bottom view of the invention.

FIG. 7 shows direct bottom view of the attachment 30 again showing the position of the attachment surface 34, the attachment holes 36 and the opening 38. The attachment holes 36 can be configured to allow connection to the various types of nailer guns.

Figure 8:
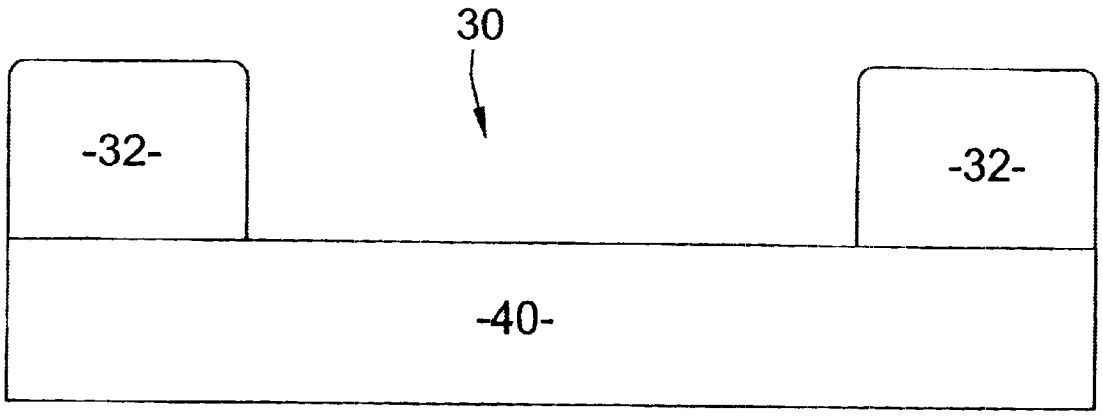
FIG. 8 is a direct front view of the invention.

FIG. 8 shows a direct front view of the attachment 30 showing the position of the vertical arms 32 and the front plate 40 which serves as a further contact point for the tool.

Figure 9:
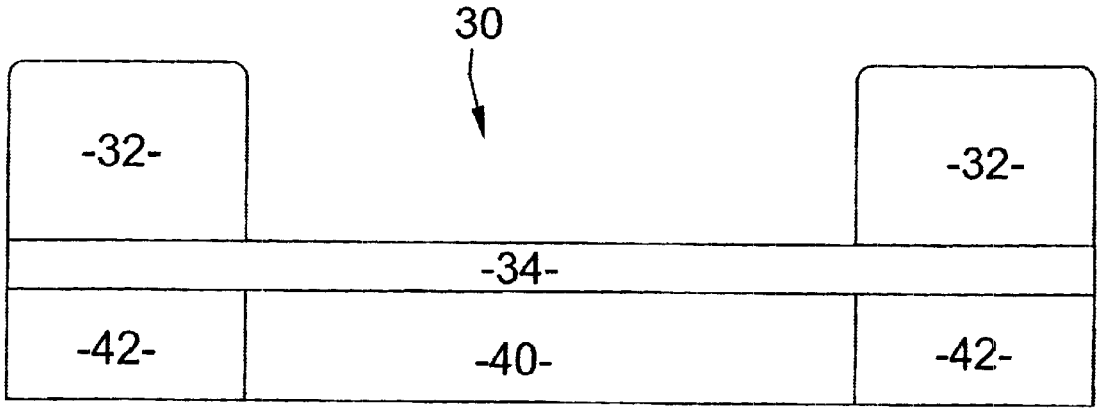
FIG. 9 is a direct rear view of the invention.

FIG. 9 shows a direct rear view of the attachment 30 wherein the vertical arms 32 extend to the attachment surface 34. Below the attachment surface 34, a pair of guides 42 extends vertically downward and serves as a guide point between the attachment, the fastener driving tool and the construction material. Finally, the front plate 40 can be seen from this rear view where it hangs below the attachment plate. Because the attachment surface 34 is not as deep as the front plate 40, no contact is made between the fastener driving tool, the attachment surface 34 and the construction material. The front plate 40 and guides 42 connect with the tongue of the construction material. This eliminates impact upon the top surface of the construction material by the fastener-driving tool thereby eliminating visible impact damage in the finished product.

Figure 10:
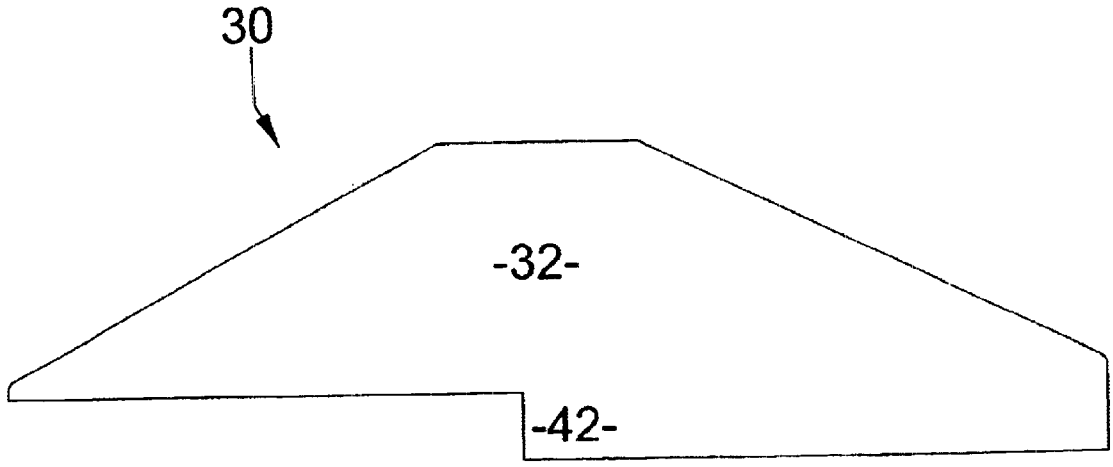
FIG. 10 is a side view of the invention.

FIG. 10 shows a direct side view of the attachment 30 wherein the vertical arms 32 and the guides 42 are shown.

Figure 11:
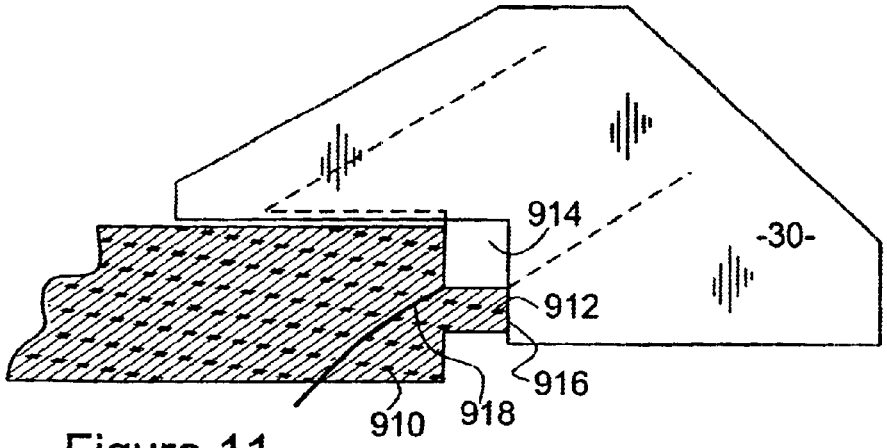
FIG. 11 is a fragmentary, cross-sectional schematic illustration of an attachment in accordance with the present invention, showing the relative position of the nail gun or other tool.

FIG. 11 shows the attachment 30 of FIG. 10, in position relative to the flooring material 910, with the attachment 30 making contact with the front surface 916 of the tongue 912. An open space 914 exists between the attachment 30 and the groove of the flooring material 910. The position of a nail 918 as it enters and fastens the flooring material 910 is shown.

Figure 12:
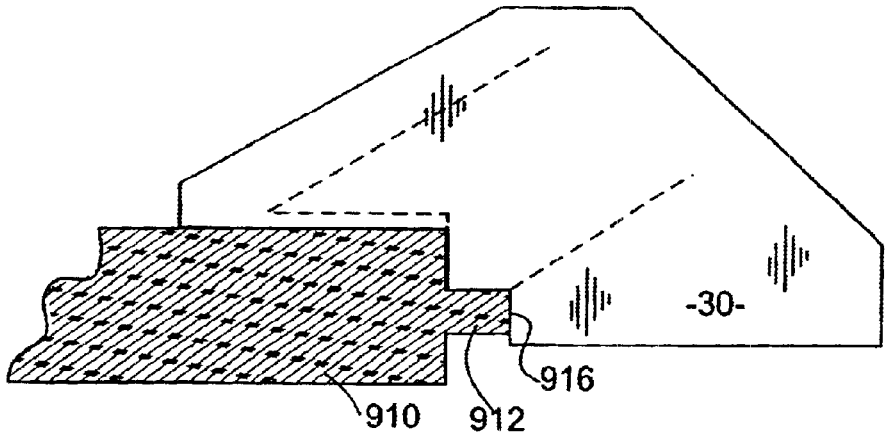
FIG. 12 is a fragmentary, cross sectional schematic illustration of a variation of the attachment, showing a stepped guide as it impacts a tongue and groove flooring material.

FIG. 12 shows an alternate design of the attachment 30 in position relative to the flooring material 910. The open space described in FIG. 11 is filled on the attachment 30 to form a step that fits into both the tongue 912 and the groove of the flooring material 910. The impact point remains at the front surface 916 of the tongue 912 of the flooring material 910.

While the invention has been described in detail and with reference to specific embodiments thereof, it would be apparent to those skilled in the art that various changes and modifications may be made therein without departing from the spirit and scope of the invention.

I claim:

1. A fastener-driving tool combination comprising a fastener-driving device and an accessory for redirecting the contact point of said device to the front surface of a tongue, of tongue and groove flooring material, said fastener-driving tool having a bottom surface and a pair of side surfaces, said accessory having a body, said body having an extended bottom surface, said extended bottom surface lying in a first plane and a second plane, said first plane being parallel to said second plane, and a front plate extending between said first plane and said second plane at a right angle to each of said first plane and said second plane, said front plate providing a contact surface between said fastener-driving tool and said front surface of a tongue over a region wider than said fastener-driving tool, a cradle section, said cradle section having a pair of side walls extending at a right angle and away from said bottom surface, said fastener-driving tool being cradled within said cradle section stabilizing said fastener-driving tool and thereby eliminating inadvertent movement of said fastener-driving tool relative to said accessory and said flooring material during use, whereby said combination disperses the impact over a substantially wider area than the width of said fastener-driving tool.

2. The fastener-driving tool combination of claim 1, wherein said contact surface is at least about double the width of said fastener-driving tool.

3. The fastener-driving tool combination of claim 1, wherein said accessory body comprises a pair of laterally extending side regions, each of said side regions extending laterally from said nail gun side surface a sufficient distance to provide a surface at the top of said accessory so the user can place a foot on a laterally extending side region in order to stabilize said fastener-driving tool while fastening said flooring material in place, whereby the tendency of the fastener-driving tool to rock is reduced.

4. The device of claim 1 where said accessory is plastic.

5. The device of claim 1 where the device is rubber.

6. The device of claim 1 where the device is Teflon.

7. The device of claim 1 where the device is wood.

8. A method for eliminating damage to a flooring material during the impact fastening of flooring materials, comprising the steps of:

placing a first tongue and groove floorboard adjacent to a previously placed second floorboard;

positioning an impact device in contact with the front surface of a tongue on a tongue and groove flooring material and stabilized on the top surface of the flooring material;

said impact device having an impact mechanism section and a stabilizer section, said stabilizer section having an extended bottom surface, said extended bottom surface lying in a first plane and a second plane, said first plane being parallel to said second plane, and a front plate extending between said first plane and said second plane at a right angle to each of said first plane and said second plane, said front plate providing a contact surface between said impact device and said front surface of a tongue, said impact section extended bottom surface stabilizing said impact device against movement relative to said top surface of said flooring material and eliminating inadvertent movement of said fastener-driving tool relative to flooring during the application of impact force, and seating the groove in an adjacent tongue by applying impact force to said first floorboard and fastening said first floorboard to said second floorboard and wherein said front place disperses said impact force over a substantially wider area than the width of said impact mechanism section, further comprising the step of placing a foot on a laterally extending side region of said stabilizer section and thereby stabilizing impact device while fastening said flooring material in place, whereby the tendency of said impact device to rock is reduced.

* * * * *